US007229292B1

(12) United States Patent
Haider et al.

(10) Patent No.: US 7,229,292 B1
(45) Date of Patent: Jun. 12, 2007

(54) INTERCONNECT STRUCTURE FOR TRANSDUCER ASSEMBLY

(75) Inventors: Bruno Hans Haider, Ballston Lake, NY (US); Douglas Glenn Wildes, Ballston Lake, NY (US); Robert Stephen Lewandowski, Amsterdam, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/315,641

(22) Filed: Dec. 22, 2005

(51) Int. Cl.
*H01R 12/00* (2006.01)

(52) U.S. Cl. ..... 439/67; 310/334

(58) Field of Classification Search ..... 439/66–67, 439/77, 492; 310/324, 334; 367/140
See application file for complete search history.

(56) References Cited

U.S. PATENT DOCUMENTS 5,267,221 A 11/1993 Miller et al. ..... 367/140
5,744,898 A * 4/1998 Smith et al. ..... 310/334
6,541,896 B1 4/2003 Piel, Jr. et al. ..... 310/334
6,551,248 B2 * 4/2003 Miller ..... 600/459
6,625,854 B1 9/2003 Sudol et al. ..... 29/25.35
2004/0100163 A1 5/2004 Baumgartner et al. ..... 310/334
2005/0272183 A1 * 12/2005 Lukacs et al. ..... 438/109

* cited by examiner

*Primary Examiner*—Michael C. Zarroli
(74) *Attorney, Agent, or Firm*—Fletcher Yoder

(57) ABSTRACT

An interconnect assembly is presented. The assembly includes an interconnect structure including a plurality of interconnect layers disposed in a spaced relationship, where each of the plurality of interconnect layers comprises a plurality of conductive traces disposed thereon. Furthermore, the assembly includes a redistribution layer disposed proximate the interconnect structure, where the redistribution layer is configured to facilitate coupling the interconnect structure to the one or more transducer elements on the transducer array.

22 Claims, 5 Drawing Sheets

INTERCONNECT STRUCTURE FOR TRANSDUCER ASSEMBLY

BACKGROUND

The invention relates generally to transducers, and more specifically to a transducer assembly.

Transducers, such as acoustic transducers, have found application in medical imaging where an acoustic probe is held against a patient and the probe transmits and receives ultrasound waves, which in turn may facilitate the imaging of the internal tissues of the patient. For example, transducers may be employed to image the heart of the patient.

Transducer assemblies generally include a transducer array, such as a two-dimensional transducer array, having one or more transducer elements arranged in a spaced relationship. Additionally, connecting elements are disposed directly underneath a respective transducer element. Spacing between each of the connecting elements is determined by spacing between the respective transducer elements.

The transducer assembly may also include an interconnect structure having a plurality of layers of interconnect configured to facilitate electrically coupling the connecting elements to an external device, such as a cable assembly or readout electronics. Typically, the interconnect structure is formed by stacking a plurality of interconnect layers, where each of the plurality of interconnect layers includes a plurality of conductive traces patterned thereon. The conductive traces may be configured to facilitate coupling connecting elements associated with each of the one or more transducer elements on the transducer array to associated electronics. Furthermore, spacing between each of the plurality of traces in a first direction is configured to match spacing between the connecting elements. Similarly, a spacing between each of the plurality of interconnect layers is configured to match a spacing between the transducer elements in a second direction. Consequently, a desired number of interconnect layers is dependent on the number of connecting elements in the second direction thereby resulting in use of a substantially high number of interconnect layers. A typical transducer may necessitate use of a number of interconnect layers in a range from about 40 to about 100. This increase in the number of interconnect layers results in enhanced complexity of interconnections and is not cost-effective.

Previously conceived solutions have incorporated multi-layer flexible interconnect circuits to facilitate coupling the plurality of transducer elements to an external device, such as readout electronics or a cable assembly. However, these multi-layer flex circuits route conductors on multiple flexible layers parallel to the plane of the transducer elements. Unfortunately, these interconnect circuits are expensive and fail to efficiently utilize space within a catheter. Additionally, acoustic performance of transducers fabricated with such methods has suffered due to the presence of an acoustically unfavorable interconnect circuit immediately underneath the transducer elements.

There is therefore a need for a transducer assembly with reduced complexity of interconnections. In particular there is a significant need for a design of a transducer assembly that advantageously reduces the number of interconnect layers in the transducer assembly. Also, it would be desirable to develop a simple and cost-effective method of fabricating a transducer assembly with reduced complexity of interconnections.

BRIEF DESCRIPTION

Briefly, in accordance with aspects of the present technique, an interconnect assembly is presented. The assembly includes an interconnect structure including a plurality of interconnect layers disposed in a spaced relationship, where each of the plurality of interconnect layers comprises a plurality of conductive traces disposed thereon. Furthermore, the assembly includes a redistribution layer disposed proximate the interconnect structure, where the redistribution layer is configured to facilitate coupling the interconnect structure to the one or more transducer elements on the transducer array.

In accordance with another aspect of the present technique, a transducer assembly is presented. The assembly includes a transducer array including one or more transducer elements arranged in a spaced relationship. Additionally, the assembly includes an interconnect structure including a plurality of interconnect layers disposed in a spaced relationship, where each of the plurality of interconnect layers comprises a plurality of conductive traces disposed thereon, and where a number of the plurality of conductive traces disposed on each of the plurality of interconnect layers is inversely proportional to a number of interconnect layers in the interconnect structure.

In accordance with further aspects of the present technique, a transducer assembly is included. The assembly includes a transducer array comprising one or more transducer elements arranged in an 'N×M' grid, where N and M are integers. Furthermore, the assembly includes an interconnect structure disposed proximate the transducer array and comprising 'K' interconnect layers disposed in a spaced relationship, where each of the 'K' interconnect layers comprises 'L' conductive traces disposed thereon, where 'K' is less than 'M' and 'L' is greater than 'N', and where 'K' and 'L' are integers. Additionally, the assembly includes a redistribution layer disposed proximate the interconnect structure, where the redistribution layer is configured to facilitate coupling the interconnect structure to the one or more elements in the transducer array.

In accordance with yet another aspect of the present technique a method for forming a transducer assembly is presented. The method includes providing a transducer array having one or more transducer elements arranged in a spaced relationship. Further, the method includes forming an interconnect structure by disposing a plurality of interconnect layers in a spaced relationship, where each of the plurality of interconnect layers comprises a plurality of conductive traces disposed thereon, and where a number of the plurality of conductive traces disposed on each of the plurality of interconnect layers is inversely proportional to a number of interconnect layers in the interconnect structure. The method also includes disposing a redistribution layer between the interconnect structure and the transducer array to facilitate coupling the transducer array to the interconnect structure. In addition, the method includes coupling the interconnect structure to the transducer array via the redistribution layer.

In accordance with further aspects of the present technique a system is presented. The system includes an acquisition subsystem configured to acquire image data, where the acquisition subsystem includes a probe configured to image a region of interest, where the probe includes at least one transducer assembly, and where the at least one transducer assembly includes a transducer array comprising one or more transducer elements arranged in an 'N×M' grid, where N and M are integers, an interconnect structure disposed proximate the transducer array and comprising 'K' interconnect layers disposed in a spaced relationship, where each of the 'K' interconnect layers comprises 'L' conductive traces disposed thereon, where 'K' is less than 'M' and 'L' is greater than 'N', and where 'K' and 'L' are integers, and a redistribution layer disposed proximate the interconnect structure, where the redistribution layer is configured to facilitate coupling the interconnect structure to the one or more transducer elements on the transducer array. In addition, the system includes a processing subsystem in operative association with the acquisition subsystem and configured to process the image data acquired via the acquisition subsystem.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As will be described in detail hereinafter, a transducer assembly with reduced complexity of interconnections and methods of fabricating the transducer assembly are presented. It is desirable to develop a transducer assembly that advantageously reduces the number of interconnect layers in an interconnect structure in the transducer assembly. Also, it would be desirable to develop a simple and cost-effective method of fabricating a transducer assembly with reduced complexity of interconnections. The techniques discussed herein address some or all of these issues.

Figure 1:
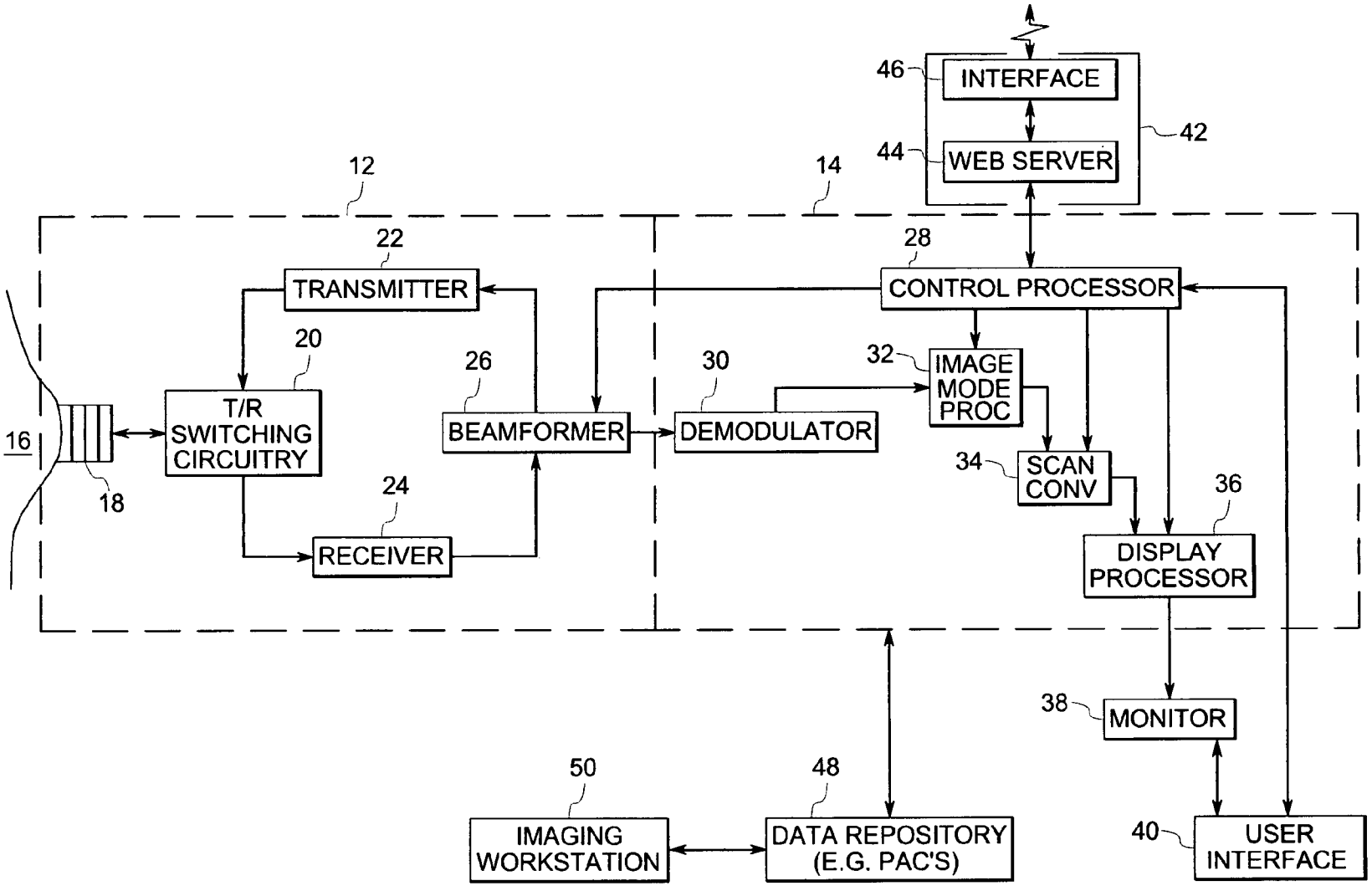
FIG. 1 is a block diagram of an imaging system, in accordance with aspects of the present technique.

FIG. 1 is a block diagram of an embodiment of an ultrasound system 10. It may be noted that figures are drawn for illustrative purposes and are not drawn to scale. It may also be noted that, although the embodiments illustrated are described in the context of an ultrasound imaging system, other types of imaging systems such as a magnetic resonance imaging (MRI) system, an X-ray imaging system, a nuclear imaging system, a positron emission tomography (PET) system, or combinations thereof are also contemplated in conjunction with the present technique.

The ultrasound system 10 includes an acquisition subsystem 12 and a processing subsystem 14. The acquisition subsystem 12 includes a transducer assembly 18, transmit/receive switching circuitry 20, a transmitter 22, a receiver 24, and a beamformer 26. In certain embodiments, the transducer assembly 18 may include a plurality of transducer elements (not shown) arranged in a spaced relationship to form a transducer array, such as a two-dimensional transducer array, for example. Additionally, the transducer assembly 18 may include an interconnect structure (not shown) configured to facilitate operatively coupling the transducer array to an external device (not shown), such as, but not limited to, a cable assembly or associated electronics. In the illustrated embodiment, the interconnect structure may be configured to couple the transducer array to the T/R switching circuitry 20.

The processing subsystem 14 includes a control processor 28, a demodulator 30, an imaging mode processor 32, a scan converter 34 and a display processor 36. The display processor 36 is further coupled to a display monitor 38 for displaying images. User interface 40 interacts with the control processor 28 and the display monitor 38. The control processor 28 may also be coupled to a remote connectivity subsystem 42 including a web server 44 and a remote connectivity interface 46. The processing subsystem 14 may be further coupled to a data repository 48 configured to receive ultrasound image data. The data repository 48 interacts with an imaging workstation 50.

The aforementioned components may be dedicated hardware elements such as circuit boards with digital signal processors or may be software running on a general-purpose computer or processor such as a commercial, off-the-shelf personal computer (PC). The various components may be combined or separated according to various embodiments of the invention. Thus, those skilled in the art will appreciate that the present ultrasound system 10 is provided by way of example, and the present techniques are in no way limited by the specific system configuration.

In the acquisition subsystem 12, the transducer array 18 is in contact with a patient or subject 16. The transducer array is coupled to the transmit/receive (T/R) switching circuitry 20. Also, the T/R switching circuitry 20 is in operative association with an output of transmitter 22 and an input of the receiver 24. The output of the receiver 24 is an input to the beamformer 26. In addition, the beamformer 26 is further coupled to the input of the transmitter 22 and to the input of the demodulator 30. The beamformer 26 is also operatively coupled to the control processor 28 as shown in FIG. 1.

In the processing subsystem 14, the output of demodulator 30 is in operative association with an input of an imaging mode processor 32. Additionally, the control processor 28 interfaces with the imaging mode processor 32, the scan converter 34 and the display processor 36. An output of imaging mode processor 32 is coupled to an input of scan converter 34. Also, an output of the scan converter 34 is operatively coupled to an input of the display processor 36. The output of display processor 36 is coupled to the monitor 38.

The ultrasound system 10 transmits ultrasound energy into the subject 16 and receives and processes backscattered ultrasound signals from the subject 16 to create and display an image. To generate a transmitted beam of ultrasound energy, the control processor 28 sends command data to the beamformer 26 to generate transmit parameters to create a beam of a desired shape originating from a certain point at the surface of the transducer array 18 at a desired steering angle. The transmit parameters are sent from the beamformer 26 to the transmitter 22. The transmitter 22 uses the transmit parameters to properly encode transmit signals to be sent to the transducer array 18 through the T/R switching circuitry 20. The transmit signals are set at certain levels and phases with respect to each other and are provided to individual transducer elements of the transducer array 18. The transmit signals excite the transducer elements to emit ultrasound waves with the same phase and level relationships. As a result, a transmitted beam of ultrasound energy is formed in a subject 16 along a scan line when the transducer array 18 is acoustically coupled to the subject 16 by using, for example, ultrasound gel. The process is known as electronic scanning.

In one embodiment, the transducer array 18 may be a two-way transducer. When ultrasound waves are transmitted into a subject 16, the ultrasound waves are backscattered off the tissue and blood samples within the subject 16. The transducer array 18 receives the backscattered waves at different times, depending on the distance into the tissue they return from and the angle with respect to the surface of the transducer array 18 at which they return. The transducer elements convert the ultrasound energy from the backscattered waves into electrical signals.

The electrical signals are then routed through the T/R switching circuitry 20 to the receiver 24. The receiver 24 amplifies and digitizes the received signals and provides other functions such as gain compensation. The digitized received signals corresponding to the backscattered waves received by each transducer element at various times preserve the amplitude and phase information of the backscattered waves.

The digitized signals are sent to the beamformer 26. The control processor 28 sends command data to beamformer 26. The beamformer 26 uses the command data to form a receive beam originating from a point on the surface of the transducer array 18 at a steering angle typically corresponding to the point and steering angle of the previous ultrasound beam transmitted along a scan line. The beamformer 26 operates on the appropriate received signals by performing time delaying and focusing, according to the instructions of the command data from the control processor 28, to create received beam signals corresponding to sample volumes along a scan line within the subject 16. The phase, amplitude, and timing information of the received signals from the various transducer elements is used to create the received beam signals.

The received beam signals are sent to the processing subsystem 14. The demodulator 30 demodulates the received beam signals to create pairs of I and Q demodulated data values corresponding to sample volumes along the scan line. Demodulation is accomplished by comparing the phase and amplitude of the received beam signals to a reference frequency. The I and Q demodulated data values preserve the phase and amplitude information of the received signals.

The demodulated data is transferred to the imaging mode processor 32. The imaging mode processor 32 uses parameter estimation techniques to generate imaging parameter values from the demodulated data in scan sequence format. The imaging parameters may include parameters corresponding to various possible imaging modes such as B-mode, color velocity mode, spectral Doppler mode, and tissue velocity imaging mode, for example. The imaging parameter values are passed to the scan converter 34. The scan converter 34 processes the parameter data by performing a translation from scan sequence format to display format. The translation includes performing interpolation operations on the parameter data to create display pixel data in the display format.

The scan converted pixel data is sent to the display processor 36 to perform any final spatial or temporal filtering of the scan converted pixel data, to apply grayscale or color to the scan converted pixel data, and to convert the digital pixel data to analog data for display on the monitor 38. The user interface 40 is coupled to the control processor 28 to allow a user to interface with the ultrasound system 10 based on the data displayed on the monitor 38.

It may be noted that, in certain embodiments, the transducer assembly 18 may be disposed in a probe. The probe may include an imaging catheter, for example.

Figure 2:
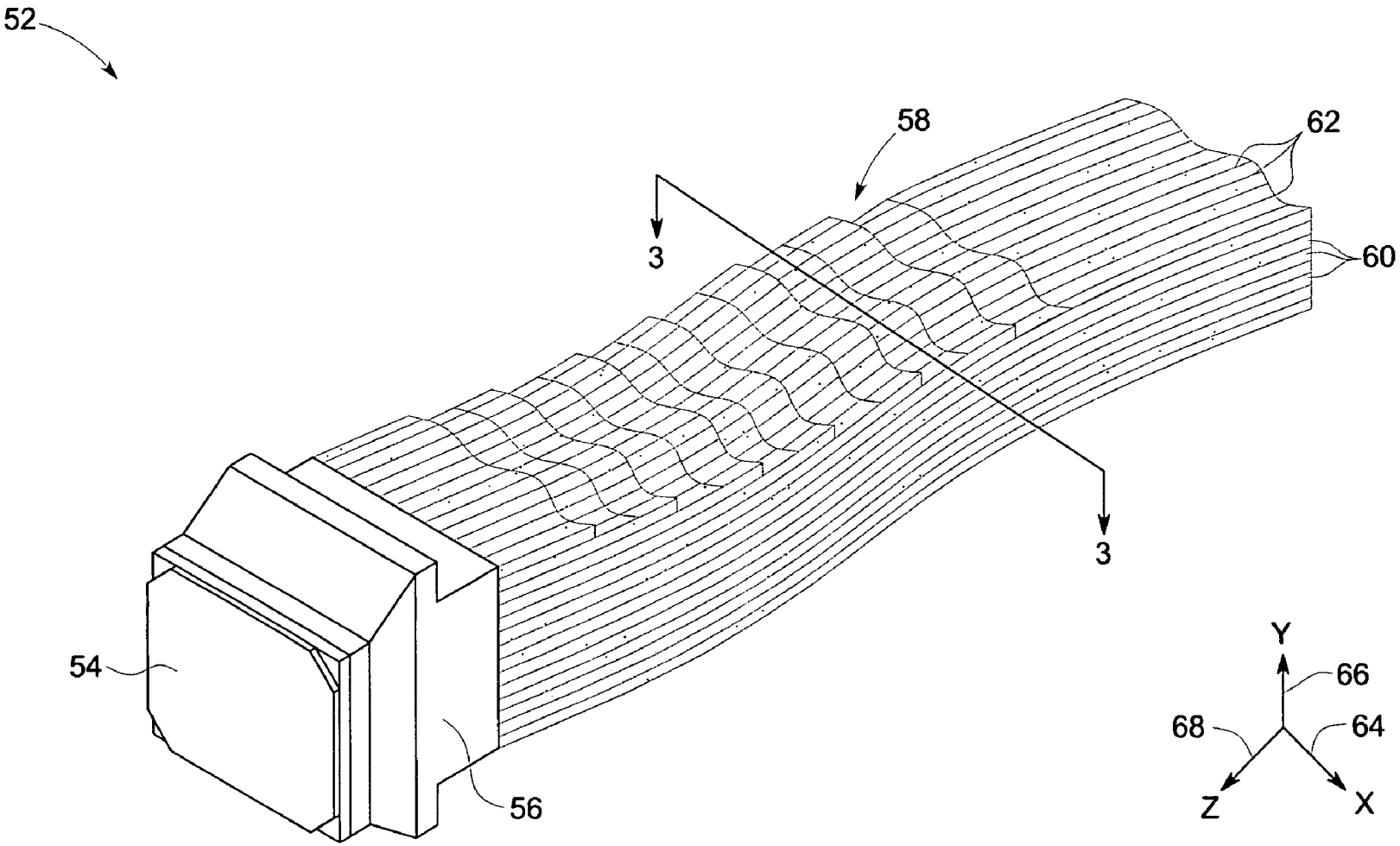
FIG. 2 is a perspective view of a transducer assembly for use in the system illustrated in FIG. 1, in accordance with aspects of the present technique.

Turning now to FIG. 2, a perspective side view of a transducer assembly 52 for use in the system 10 depicted in FIG. 1 is illustrated. Typically, the transducer assembly 52, for example, an acoustic transducer assembly, as illustrated in FIG. 2, may include one or more transducer elements (not shown), one or more matching layers (not shown) and a lens (not shown). The transducer elements may be arranged in a spaced relationship, such as, but not limited to, an array of transducer elements disposed on a layer, where each of the transducer elements may include a transducer front face 54 and a transducer rear face (not shown). As will be appreciated by one skilled in the art, the transducer elements may be fabricated employing materials, such as, but not limited to lead zirconate titanate (PZT), polyvinylidene difluoride (PVDF) or composite PZT. The transducer assembly 52 may also include one or more matching layers disposed adjacent to the front face 54 of the array of transducer elements, where each of the matching layers may include a matching layer front face and a matching layer rear face. The matching layers facilitate matching of an impedance differential that may exist between the high impedance transducer elements and a low impedance subject 16 (see FIG. 1). The lens may be disposed adjacent to the matching layer front face and provides an interface between the subject 16 and the matching layer.

Additionally, the transducer assembly 52 may include a backing structure 56, having a front face and a rear face, which may be fabricated employing a suitable acoustic damping material possessing high acoustic losses. The backing structure 56 may be acoustically coupled to the rear face of the array of transducer elements, where the backing structure 56 facilitates the attenuation of acoustic energy that may emerge from the rear face of the array of transducer elements. Additionally, the backing structure 56 is shown as having an exemplary interconnect structure 58, where the interconnect structure 58 may include a plurality of interconnect layers. In a presently contemplated configuration, the interconnect structure 58 may include a plurality of interconnect layers 60 stacked in a Y-direction 66. Moreover, a plurality of conductive traces 62 may be disposed on each of the plurality of interconnect layers 60. Reference numerals 64 and 68 are representative of an X-direction and a Z-direction respectively. It may be noted that the terms interconnect structure and interconnect assembly may be used interchangeably.

As previously discussed, it may be desirable to enhance the imaging performance of the transducer assembly 52 while reducing the number of interconnect layers 60. More particularly, it may be desirable to develop a transducer assembly that advantageously reduces a number interconnect layers in the transducer assembly. Accordingly, in a presently contemplated configuration, the transducer assembly may include an exemplary interconnect structure having a reduced number of interconnect layers and an exemplary redistribution layer. The exemplary transducer assembly having the interconnect structure and the redistribution layer will be described in greater detail hereinafter.

Moreover, the transducer assembly 52 may also include an electrical shield (not shown) that facilitates the isolation of the transducer elements from the external environment. The electrical shield may include metal foils, where the metal foils may be fabricated employing metals such as, but not limited to, copper, aluminum, brass, or gold.

Figure 3:
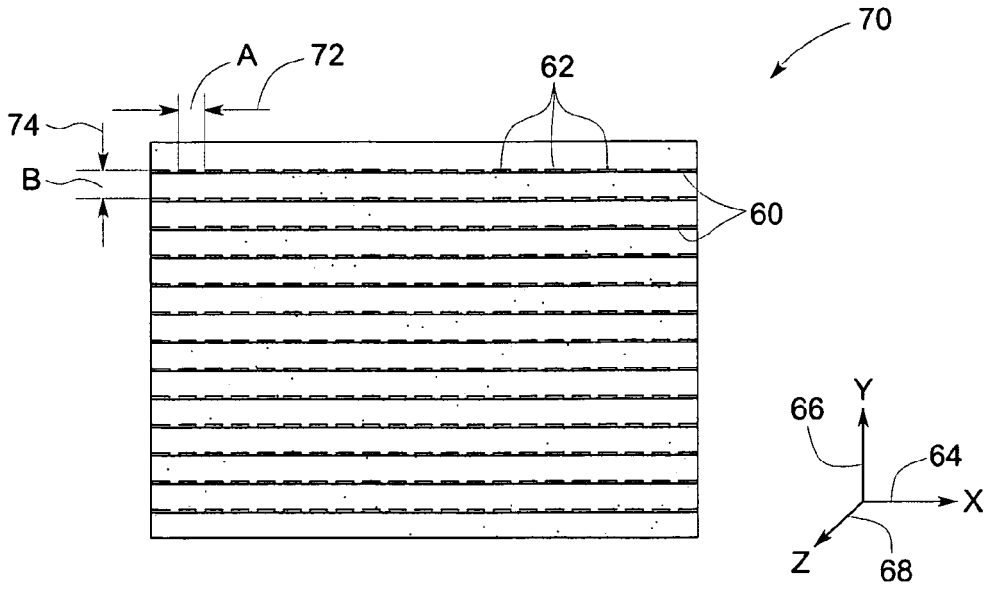
FIG. 3 is a cross-sectional view of the interconnect structure of FIG. 2 along cross-sectional line 3—3.

Referring now to FIG. 3, a cross-sectional view 70 of the interconnect structure 58 of FIG. 2 is illustrated. In accordance with aspects of the present technique, an exemplary interconnect assembly 70 that advantageously reduces a number of interconnect layers in the transducer assembly is presented.

As previously noted, a plurality of transducer elements may be arranged in a spaced relationship to form a transducer array. For example, a plurality of transducer elements may be arranged in rows and along columns to form a two-dimensional transducer array. It may be noted that the plurality of transducer elements may be arranged in a spaced relationship to form a transducer array having a predetermined shape. In certain embodiments, the predetermined shape of the transducer array may include a square, a rectangle, a circle, a rhombus, a triangle, a hexagon, an octagon, or combinations thereof.

Further, as will be appreciated, each of the plurality of transducer elements has a respective connecting element disposed directly below the respective transducer element. The connecting element may be configured to facilitate operatively coupling the transducer element to an interconnect structure. Also, it may be noted that a spacing between the connecting elements in a first direction is determined by a spacing between each of the plurality of transducer elements disposed along a row in the transducer array, while a spacing between the connecting elements in a second direction is determined by a spacing between each of the plurality of transducer elements disposed along a column in the transducer array. In certain embodiments, the first direction may be the X-direction 64 and the second direction may be the Y-direction 66.

Further, the transducer elements on the transducer array may be coupled to an interconnect structure to form a transducer assembly. As previously noted, a plurality of interconnect layers may be disposed in a spaced relationship to form the interconnect structure 70. In one embodiment, a plurality of interconnect layers 60 may be stacked in the Y-direction 66 to form the interconnect structure 70. Each of the plurality of interconnect layers 60 may include a plurality of conductive traces 62 patterned thereon, where the conductive traces 62 may be configured to facilitate coupling the connecting elements associated with the transducer elements to an external device such as a cable assembly or readout electronics, for example.

Furthermore, in the interconnect structure 70, it may be noted that a spacing between each of the plurality of conductive traces 62 on an interconnect layer 60 may be configured to match a spacing between each of the transducer elements disposed in rows in the first direction. Similarly, a spacing between each of the plurality of interconnect layers 60 in the interconnect structure 70 may be configured to match a spacing between the transducer elements disposed along columns in the second direction. Consequently, a desired number of interconnect layers 60 is dependent on the number of transducer elements disposed in the second direction, thereby resulting in use of a substantially high number of interconnect layers 60, which results in enhanced complexity of interconnections and is not cost-effective.

Previously conceived solutions have incorporated multilayer flexible interconnect circuits that route conductors on multiple flexible layers parallel to the plane of the transducer elements to facilitate coupling the plurality of transducer elements to an external device, such as a cable assembly, for example. Unfortunately, these interconnect circuits are expensive and fail to efficiently utilize space within a probe, for example. Additionally, acoustic performance of transducers fabricated with such methods has suffered due to the presence of an acoustically unfavorable interconnect circuit immediately underneath the transducer elements.

In accordance with aspects of the present technique, an exemplary interconnect assembly 70 that advantageously circumvents the shortcomings of the previously conceived solutions is presented. It may be noted that a number of interconnect layers 60 in the interconnect structure 70 and consequently a number of conductive traces 62 disposed on each of the plurality of interconnect layers 60 is determined by a number of transducer elements in the transducer array. In particular, the number of conductive traces 62 on each of the plurality of interconnect layers 60 may be dependent on a number of transducer elements disposed in the first direction along a row of the transducer array. Similarly, the number of interconnect layers 60 in the interconnect structure 70 may be dependent on the number of transducer elements disposed in the second direction along a column of the transducer array.

Consequently, the number of the plurality of conductive traces 62 disposed on each of the plurality of interconnect layers 60 is inversely proportional to the number of interconnect layers 60 in the interconnect structure 70. According to exemplary aspects of the present technique, the number of conductive traces 62 disposed on each of the plurality of interconnect layers 60 may be substantially increased thereby increasing a density of conductive traces 62 in the first direction, while the number of interconnect layers 60 that facilitate operative coupling of the plurality of transducer elements to a cable assembly, for example, may be accordingly reduced. By implementing the interconnect structure 70 as described hereinabove, a desired coupling between the transducer array and the interconnect structure 70 may be advantageously achieved via use of a reduced number of interconnect layers 60 thereby resulting in reduced interconnectivity complexity and cost.

The exemplary interconnect structure 70 may be better understood as described hereinafter. By way of example, a two-dimensional transducer array may include a plurality of transducer elements arranged in a N×M matrix grid. It may be noted that N is an integer and is representative of a number of transducers elements in the transducer array disposed in a first direction. Similarly, M is an integer and is representative of a number of transducer elements in the transducer array disposed in a second direction. Consequently, there are N×M transducer elements in the two-dimensional array. In one embodiment, the first direction may be the X-direction 64 and the second direction may be the Y-direction 66. It may be noted that, the transducer array may also have circular shape, a triangular shape, a hexagonal shape, an octagonal shape, or combinations thereof, as previously described.

Accordingly, there is a need for an interconnect structure that is capable of facilitating operatively coupling the N×M transducer elements in the transducer array while advantageously reducing the number of interconnect layers in the interconnect structure. In other words, it may be desirable to develop an interconnect structure having N×M conductive traces to facilitate coupling the N×M transducer elements on the transducer array to a cable assembly, for example. With continuing reference to FIG. 3, the number of conductive traces 62 on each of the plurality of interconnect layers 60 is determined by the number of transducer elements N disposed in the first direction, as previously described. Additionally, the number of interconnect layers 60 in the interconnect structure 70 is dependent on the number of transducer elements M disposed in the second direction. However, it is desirable to reduce the number of interconnect layers 60 in the interconnect structure 70 to facilitate reduction in interconnection complexity and cost.

In accordance with aspects of the present technique, a number of conductive traces on each of the plurality of interconnect layers 60 may be increased, while reducing a number of interconnect layers 60 in the interconnect structure 70, where the interconnect layers 60 are configured to facilitate coupling the transducer elements to an external device, such as a cable assembly or readout electronics, for example. In certain embodiments, the interconnect structure 70 may include K interconnect layers 60 arranged in a spaced relationship. Furthermore, each of the K interconnect layers 60 may include L conductive traces 62 disposed thereon. It may be noted that K and L are integers. As previously noted, N and M are representative of the number of transducer elements in the transducer array arranged along the first direction and the second direction respectively. According to exemplary aspects of the present technique, K may be configured to be relatively less than M and L may be configured to be relatively greater than N.

Accordingly, in certain embodiments, a density of conductive traces 62 on each of the plurality of interconnect layers 60 may be increased by factor F. In other words, increasing the number of conductive traces 62 on each of the plurality of interconnect layers 60 results in N×F conductive traces on each of the plurality of interconnect layers 60. It may be noted that F is typically an integer. Consequent to this increase in density of conductive traces 62 on each of the plurality of interconnect layers 60, the number of interconnect layers 60 in the interconnect structure 70 may then be accordingly reduced by a factor F, thereby resulting in M/F interconnect layers in the interconnect structure 70. Accordingly, a total number of conductive traces 62 in the interconnect structure 70 remains unchanged as represented in the following equation:

$$(N \times F) \times \left(\frac{M}{F}\right) = N \times M \tag{1}$$

Consequently, a spacing "A" 72 between each of the conductive traces 62 on each of the plurality of interconnect layers 60 in the first direction is reduced by the factor F, while a spacing "B" 74 between each of the conductive traces 62 in the second direction is increased by the factor F. However, as the density of conductive traces 62 on each of the plurality of interconnect layers 60 is increased by the factor F and the number of interconnect layers 60 in the interconnect structure 70 is reduced by a factor F, a connection pattern of the interconnect structure 70 has been altered. As used herein, the term "connection pattern" is used to depict an arrangement of the plurality of conductive traces 62 in the interconnect structure 70. In other words, the connection pattern of the exemplary interconnect structure 70 no longer matches a connection pattern of the transducer array. It may therefore be desirable to employ an intermediate device that facilitates operatively coupling the modified connection pattern of the interconnect structure 70 with reduced number of interconnect layers 62 and a connection pattern of the transducer array.

Figure 4:
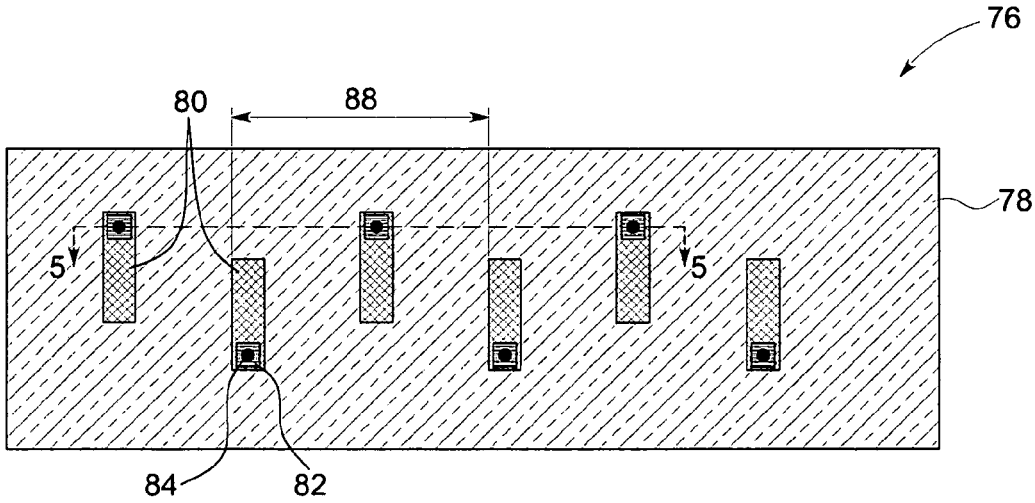
FIG. 4 is top view of an exemplary embodiment of a redistribution layer, in accordance with aspects of the present technique.

FIG. 4 illustrates an exemplary embodiment 76 of a redistribution layer. According to aspects of the present technique, an exemplary redistribution layer is presented. The redistribution layer 76 may be configured to facilitate operatively coupling the modified connection pattern of the interconnect structure, such as interconnect structure 70 (see FIG. 3) with reduced number of interconnect layers and the connection pattern of the transducer array. Furthermore, the redistribution layer 76 may have a top side and a bottom side.

In FIG. 4, a top view of the bottom side of the redistribution layer is illustrated. In one embodiment, the redistribution layer 76 may include a substrate layer 78. The substrate layer 78 may include polyester or polyimide. In certain embodiments, the polyester may include Mylar and the polyimide may include Kapton, for example. In addition, a plurality of connection pads 82 may be disposed on the top side of the substrate layer 78. The plurality of connection pads 82 disposed on the top side of the substrate layer 78 may be arranged in a desired pattern such that the pattern of the connection pads 82 matches the connection pattern of the transducer elements on the transducer array. In other words, a spacing 88 between each of the plurality of connection pads 82 may be configured to match a spacing between each of the plurality of transducer elements on the transducer array. Also, as illustrated in FIG. 4, the redistribution layer 76 may include a plurality of coupling elements 80 disposed on the bottom side of the substrate layer 78. The coupling elements 80 may be arranged such that each of the plurality of coupling elements 80 has a corresponding connection pad 82 disposed thereon. Furthermore, each of the plurality of coupling elements 80 may be configured to facilitate operatively coupling a respective connection pad 82 to a respective transducer element.

Figure 5:
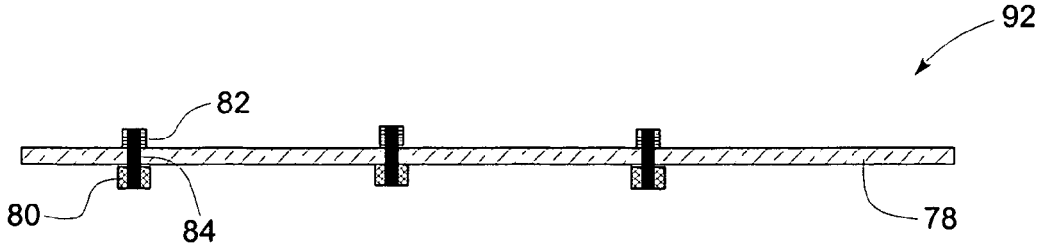
FIG. 5 is a cross-sectional view of the redistribution layer of FIG. 4 along cross-sectional line 5—5.

The redistribution layer 76 may include a plurality of coupling elements 80 patterned on the bottom side of the substrate layer 78. These coupling elements 80 may be arranged in a desired pattern such that the pattern of the coupling elements 80 matches the connection pattern of the interconnect structure. In other words, a spacing between each of the coupling elements 80 disposed on the bottom side of the substrate layer 78 may be configured to match a spacing between each of the conductive traces on an interconnect layer in the interconnect structure. Moreover, each of the coupling elements may have a respective connection pad (not shown) disposed thereon. In addition, a via is represented by reference numeral 84. The via 84 may be configured to facilitate electrically coupling the top side and the bottom side of the redistribution layer 76. FIG. 5 illustrates a cross-sectional side view 92 of the redistribution layer 76 of FIG. 4 along cross-sectional line 5—5.

By implementing the redistribution layer as described hereinabove, a desired number of interconnect layers in the interconnect structure required to facilitate coupling the transducer elements in the transducer array may advantageously be reduced. For example, as depicted in FIG. 4, the coupling elements 80 may be patterned on the bottom side of the substrate layer 78 such that the arrangement facilitates coupling two adjacent rows of the transducer array having three transducer elements each to a single interconnect layer.

Figure 6:
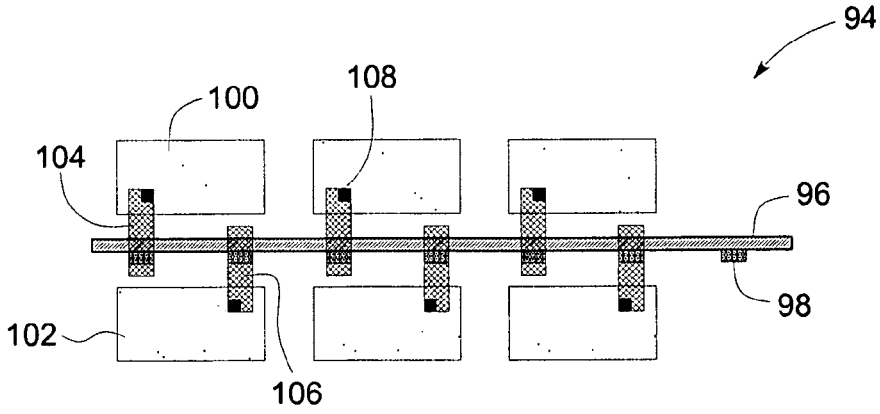
FIG. 6 is a diagram of an exemplary embodiment of a transducer assembly having a redistribution layer, in accordance with aspects of the present technique.

Referring now to FIG. 6, an exemplary embodiment 94 of a portion of a transducer assembly having a redistribution layer is illustrated. In a presently contemplated configuration, the transducer assembly 94 is shown as including an interconnect layer 96 and a plurality of transducer elements and connecting structure associated with the transducer elements. It may be noted that the interconnect layer 96 includes an increased density of conductive traces 98 disposed thereon. The transducer assembly 94 may also include an exemplary redistribution layer having a first set of coupling elements 104 and a second set of coupling elements 106 disposed on the bottom side of the redistribution layer. As previously noted, the coupling elements 104, 106 may be configured to facilitate coupling the conductive traces 98 to the transducer elements on the transducer array.

In the illustrated embodiment, the interconnect layer 96 may include a flexible interconnect layer having a first side and a second side. Additionally, the interconnect layer 96 may include a plurality of conductive traces 98 disposed on the first side. As previously noted, the single-sided interconnect layer 96 includes a relatively high density of conductive traces 98 disposed thereon, which advantageously facilitates reducing the desired number of interconnect layers in an interconnect assembly. Also, reference numeral 100 is representative of a plurality of transducer elements disposed in a row of a two-dimensional transducer array, such as a first row, for example. Furthermore, reference numeral 102 is representative of a plurality of transducer elements disposed in a second row of the transducer array, where the second row may be adjacent to the first row, for example. Furthermore, in certain embodiments, the interconnect layer 96 may be disposed between the first and second rows of transducer elements 100, 102, as illustrated in FIG. 6.

As depicted in FIG. 6, the first set of coupling elements 104 may be configured to operatively couple the plurality of conductive traces 98 disposed on the single-sided interconnect layer 96 to the plurality of transducer elements 100 disposed in the first row of the transducer array. In a similar fashion, the second set of coupling elements 106 may be configured to operatively couple the plurality of conductive traces 98 disposed on the single-sided interconnect layer 96 to the plurality of transducer elements 106 disposed in the second row of the transducer array. Furthermore, reference numeral 108 represents a via configured to facilitate electrically coupling the top side and the bottom side of the redistribution layer. The coupling elements 104, 106 on the redistribution layer may be configured to operatively couple each of plurality of transducer elements 100, 102 to a respective conductive trace 98 on the interconnect layer 96.

Consequently, the coupling elements 104, 106 disposed on the redistribution layer may be advantageously configured to operatively couple the interconnect layer 96 having an increased density of conductive traces 98 to a plurality of transducer elements disposed in adjacent rows of a transducer assembly, thereby resulting in use of a reduced number of interconnect layers in the interconnect assembly. In the illustrated embodiment, the exemplary redistribution layer may be configured to facilitate coupling a single interconnect layer 96 to transducer elements disposed in two rows on the transducer array. By implementing the redistribution layer as described hereinabove, interconnections in the transducer assembly 94 may be achieved via a reduced number of interconnect layers 96, where each of the interconnect layers 96 has an increased density of conductive traces 98 disposed thereon. In other words, in the illustrated exemplary embodiment of the transducer assembly 94, the desired number of interconnect layers 96 to facilitate coupling the transducer elements 100, 102 to respective conductive traces 98 on the interconnect layers 96 may be reduced by a factor of two. Additionally, signal routing on the redistribution layer may be realized without any signal crossovers.

Figure 7:
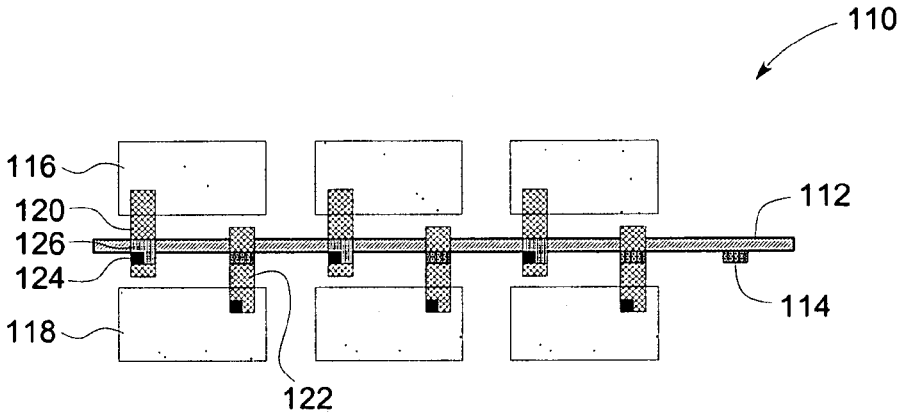
FIG. 7 is a diagram of an alternate exemplary embodiment of a transducer assembly having a redistribution layer, in accordance with aspects of the present technique.

FIG. 7 shows an alternate exemplary embodiment 110 of a portion of a transducer assembly having a redistribution layer is illustrated. As described with reference to FIG. 6, the illustrated embodiment of the transducer assembly 110 is shown as including an interconnect layer 112 having a plurality of conductive traces 114 disposed on a bottom side of the interconnect layer 112. In addition, the transducer assembly 110 includes a plurality of transducer elements and connecting structure associated with the transducer elements. The transducer assembly 112 may also include an exemplary redistribution layer having a first set of coupling elements 120 disposed on a top side of the redistribution layer and a second set of coupling elements 122 disposed on a bottom side of the redistribution layer.

Also, as described with reference to FIG. 6, reference numeral 116 is representative of a plurality of transducer elements disposed in a first row of a two-dimensional transducer array. Furthermore, reference numeral 118 is representative of a plurality of transducer elements disposed in a second row of the two-dimensional transducer array, where the second row may be disposed adjacent to the first row, for example. In one embodiment, the interconnect layer 112 may be disposed between the first and second rows of transducer elements 116, 118, as illustrated in FIG. 7.

Furthermore, as depicted in FIG. 7, the first set of coupling elements 120 disposed on the top side of the redistribution layer may be configured to operatively couple the plurality of conductive traces 114 disposed on the single interconnect layer 112 to the plurality of transducer elements 116 disposed in the first row of the transducer array. In a similar fashion, the second set of coupling elements 122 disposed on the bottom side of the redistribution layer may be configured to operatively couple conductive traces 114 disposed on the single interconnect layer 112 to the plurality of transducer elements 118 disposed in the second row of the transducer array. Furthermore, reference numeral 124 represents a via configured to facilitate electrically coupling the top side and the bottom side of the redistribution layer. The coupling elements 120, 122 on the redistribution layer may be configured to operatively couple each of plurality of transducer elements 116, 118 to a respective conductive trace 114 on the interconnect layer 112. Additionally, reference numeral 126 represents a flex connection pad disposed on the bottom side of the redistribution layer. The flex connection pad 126 may be configured to couple coupling element 104 (see FIG. 6) and transducer element 100 (see FIG. 6) to a respective trace 114 on the interconnect layer 112. As noted with reference to FIG. 6, in the illustrated exemplary embodiment of the transducer assembly 110, a desired number of interconnect layers to facilitate coupling the transducer elements to respective conductive traces on the interconnect layers may be advantageously reduced by a factor of two.

Figure 8:
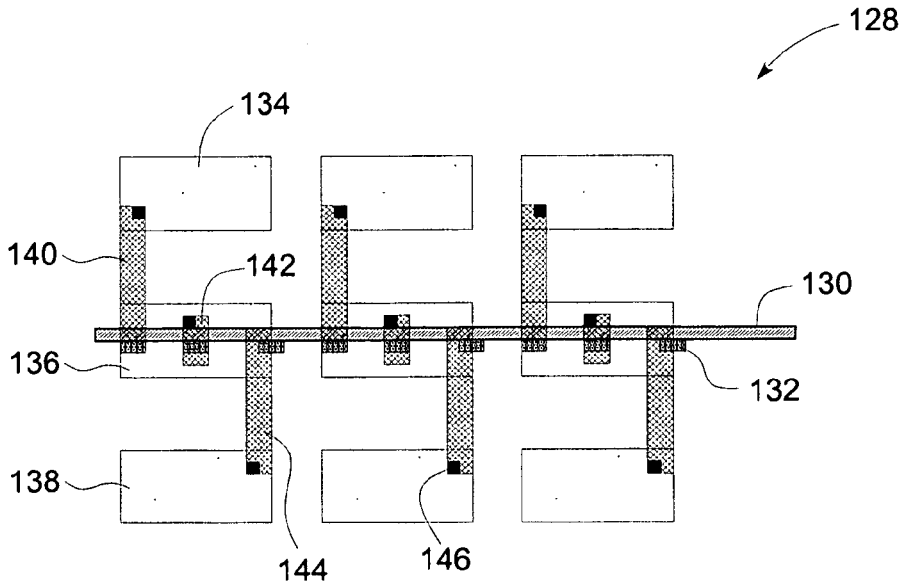
FIG. 8 is a diagram of yet another exemplary embodiment of a transducer assembly having a redistribution layer, in accordance with aspects of the present technique.

Turning now to FIG. 8, an exemplary embodiment 128 of a transducer assembly where a redistribution layer may be configured to facilitate coupling a single interconnect layer 130 to transducer elements disposed in three rows on the transducer array is illustrated. As previously noted, the interconnect layer 130 may include an increased density of conductive traces 132 disposed on a bottom side. Reference numeral 134 represents a plurality of transducer elements disposed in a first row of the transducer array, while a plurality of transducer elements disposed in a second row of the transducer array is represented by reference numeral 136. Similarly, reference numeral 138 represents a plurality of transducer elements disposed in a third row of the transducer array. In one exemplary embodiment, the first row, the second row and the third row of transducer elements may be disposed adjacent to one another.

Also, the redistribution layer may be configured to include a first set 140, a second set 142 and a third set 144 of coupling elements disposed thereon. In a presently contemplated configuration, the first set 140, the second set 142 and the third set 144 of coupling elements 140 may be disposed on a bottom side of the redistribution layer. Moreover, in the illustrated embodiment, the first set of coupling elements 140 may be configured to facilitate operatively coupling each of the transducer elements 134 disposed in the first row of the transducer array to a respective conductive trace 132 on the interconnect layer 130. Similarly, each of the transducer elements 136 disposed in the second row of the transducer array may be operatively coupled to a respective conductive trace 132 via the second set of coupling elements 142. In a similar fashion, the third set of coupling elements 144 may be configured to facilitate operatively coupling the transducer elements 138 disposed in the third row to a respective conductive trace 132. The coupling elements 140, 142, 144 on the redistribution layer may be configured to operatively couple each of plurality of transducer elements 134, 136, 138 to a respective conductive trace 132 on the interconnect layer 130. Reference numeral 146 is representative of a via that may be configured to facilitate operatively coupling the top side and the bottom side of the redistribution layer. By implementing the transducer assembly as described with reference to FIG. 8, a single interconnect layer 130 may be employed to facilitate coupling the plurality of transducer elements disposed in three adjacent rows on the transducer array. Consequently, in the illustrated exemplary embodiment, a desired number of interconnect layers in the interconnect structure is advantageously reduced by a factor of three.

Implementing the redistribution layer as described hereinabove advantageously allows reconfiguration of the interconnect structure. In other words, use of the redistribution layer facilitates reduction in a number of interconnect layers in the interconnect structure by allowing an increase in the density of conductive traces on each of the plurality of interconnect layers, thereby permitting a reduction in the number of interconnect layers required to facilitate coupling the transducer elements to a cable assembly, for example.

As described hereinabove, the plurality of coupling elements disposed on the top side and the bottom side of the redistribution layer may be configured to operatively couple the transducer elements disposed in adjacent rows to respective conductive traces on a single interconnect layer. However, this arrangement of the coupling elements in the redistribution layer may result in a non-uniform thickness of the redistribution layer. This non-uniform thickness of the redistribution layer may reduce contact adhesion during final assembly of the transducer assembly. In accordance with aspects of the present technique, contact adhesion may be improved via introduction of one or more dummy coupling elements in the redistribution layer. These dummy coupling elements advantageously facilitate creating a redistribution layer having a uniform thickness. It may be noted that these dummy coupling elements do not create electrical connections between transducer elements and the interconnect structure.

It may also be noted that although the embodiments of the transducer assembly having the redistribution layer illustrated in FIGS. 6–8 depict embodiments of the transducer assembly where the number of interconnect layers may be reduced by a factor two and three, it will be appreciated that a reduction in the number of interconnect layers by other values may also be envisioned in accordance with aspects of the present technique.

In accordance with aspects of the present technique, in certain embodiments of the transducer assembly, the redistribution layer may be patterned directly on the interconnect structure. Alternatively, in certain other embodiments, the redistribution layer may be patterned directly on the transducer array.

Figure 9:
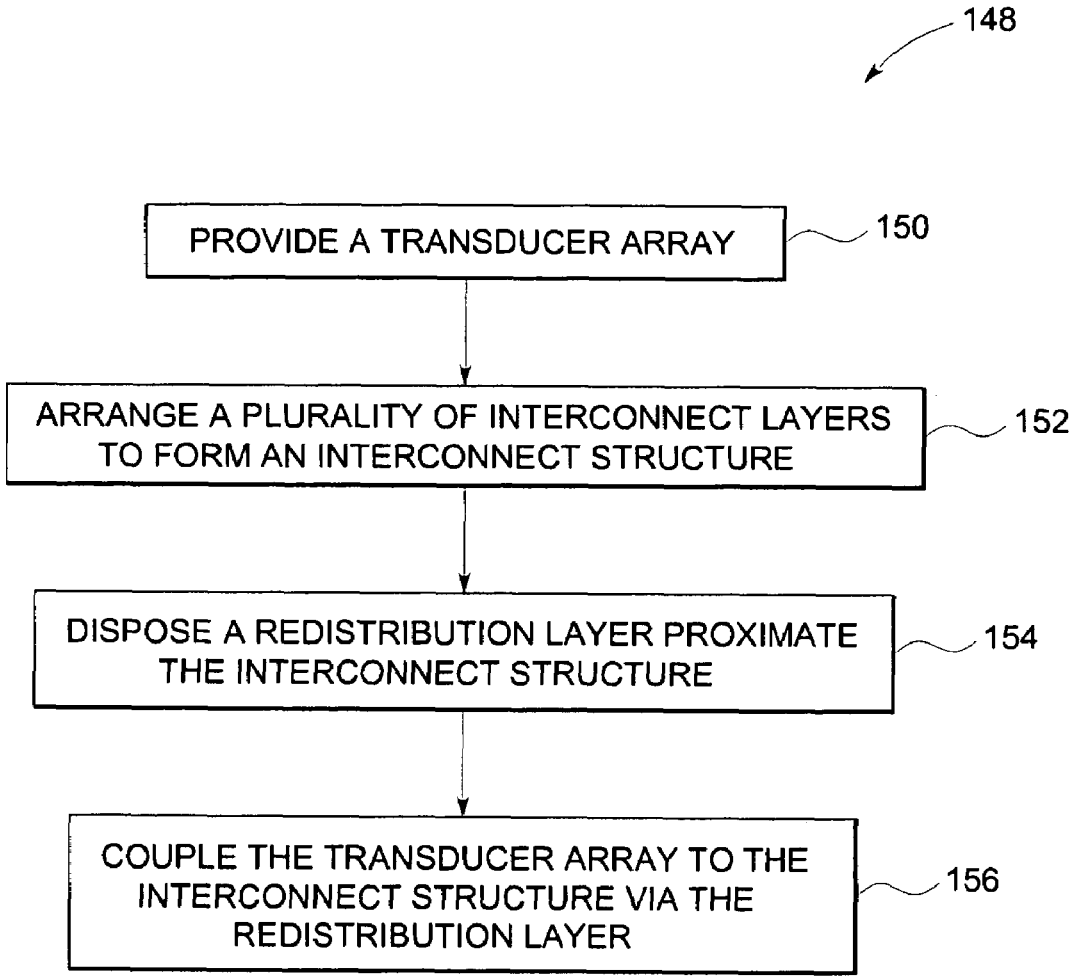
FIG. 9 is a flow chart depicting steps for interconnecting transducer elements on a transducer array to an interconnect structure via a redistribution layer, in accordance with aspects of the present technique.

FIG. 9 is a flow chart of exemplary logic 148 for forming a transducer assembly having a redistribution layer. In accordance with exemplary aspects of the present technique, a method for forming a transducer assembly having a redistribution layer is presented. The method starts at step 150 where a plurality of transducer elements may be arranged in a spaced relationship to form a transducer array. For example, the plurality of transducer elements may be disposed in rows and along columns to form a two-dimensional array.

At step 152, an exemplary interconnect structure configured to facilitate coupling the plurality of transducer elements of the transducer array to an external device, such as a cable assembly, may be formed. The interconnect structure may be formed by disposing a plurality of interconnect layers in a spaced relationship. In one embodiment, the plurality of interconnect layers may be stacked to form the interconnect structure. As previously noted, a number of the plurality of conductive traces disposed on each of the plurality of interconnect layers is inversely proportional to a number of interconnect layers in the interconnect structure. In other words, a density of the conductive traces disposed on each of the plurality of interconnect layers may be substantially increased. Consequently, a number of interconnect layers that facilitate operative coupling of the plurality of transducer elements to a cable assembly, for example, may be accordingly reduced.

As previously described, due to the increased density of conductive traces on each of the plurality of interconnect layers and a reduction in the number of interconnect layers in the interconnect structure, a connection pattern of the interconnect structure no longer matches a connection pattern of the transducer array. Accordingly, at step 154, an exemplary redistribution layer configured to facilitate operatively coupling the connection pattern of the interconnect structure with reduced number of interconnect layers and a connection pattern of the transducer array may be disposed proximate the interconnect structure. In one embodiment, the redistribution layer may include a substrate layer having a top side and a bottom side. The substrate layer may include polyester or polyimide. In certain embodiments, the polyester may include Mylar and the polyimide may include Kapton, for example. In addition, a plurality of coupling elements may be disposed on the top side and the bottom side of the redistribution layer. The plurality of coupling elements disposed on the bottom side of the redistribution layer may be arranged in a desired pattern on the substrate layer such that the pattern of the coupling elements matches the connection pattern of the interconnect structure. In a similar fashion, a pattern of coupling elements disposed on the top side of the substrate may be configured to match the connection pattern of the transducer elements on the transducer array.

Subsequently, the plurality of transducer elements may be operatively coupled to the conductive traces on each of the interconnect layers in the interconnect structure via the coupling elements on the redistribution layer at step 156 to form an exemplary transducer assembly.

The various embodiments of the transducer assembly having the interconnect structure with a reduced number of interconnect layers and the redistribution layer and method of producing the various embodiments of the transducer assembly advantageously facilitate reduction in a number of interconnect layers in a transducer assembly, thereby facilitating reduction in interconnection complexity. This reduction in the number of interconnect layers advantageously results in lower production cost. Furthermore, employing the redistribution layer to facilitate coupling the transducer array to the interconnect structure permits reduction in the number of interconnect layers, thereby dramatically reducing complexities associated with assembling the transducer assembly. Additionally, employing the techniques of forming the transducer assembly described hereinabove facilitates building cost-effective transducers for use in imaging systems.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An interconnect assembly, comprising:

an interconnect structure comprising a plurality of interconnect layers disposed in a spaced relationship, wherein each of the plurality of interconnect layers comprises a plurality of conductive traces disposed thereon; and a redistribution layer disposed proximate the interconnect structure, wherein the redistribution layer is configured to facilitate coupling the interconnect structure to the one or more transducer elements on a transducer array, the redistribution layer having a top side and a bottom side, the top side and the bottom side of the redistribution layer each having a plurality of coupling elements disposed thereon.

2. The assembly of claim 1, wherein a number of the plurality of conductive traces disposed on each of the plurality of interconnect layers is inversely proportional to a number of interconnect layers in the interconnect structure.

3. The assembly of claim 1, wherein a pitch of the coupling elements disposed on the top side of the redistribution layer is configured to facilitate coupling the redistribution layer to the one or more transducer elements on the transducer array and a pitch of the coupling elements disposed on the bottom side of the redistribution layer is configured to facilitate coupling the redistribution layer to the plurality of conductive traces on the plurality of interconnect layers in the interconnect structure.

4. The assembly of claim 1, wherein the redistribution layer comprises a plurality of vias configured to facilitate operatively coupling the one or more coupling elements disposed on the top side of the redistribution layer to the one or more coupling elements disposed on the bottom side of the redistribution layer.

5. The assembly of claim 1, wherein the redistribution layer is disposed directly on the interconnect structure.

6. A transducer assembly, comprising:

a transducer array comprising one or more transducer elements arranged in a spaced relationship; and an interconnect structure comprising a plurality of interconnect layers disposed in a spaced relationship, wherein each of the plurality of interconnect layers comprises a plurality of conductive traces disposed thereon, and wherein a number of the plurality of conductive traces disposed on each of the plurality of interconnect layers is inversely proportional to a number of interconnect layers in the interconnect structure; and a redistribution layer disposed proximate the interconnect structure, wherein the redistribution layer is configured to facilitate coupling the interconnect structure to the one or more transducer elements on the transducer array, the redistribution layer comprising a plurality of coupling elements disposed on a top side and a bottom side thereof.

7. The assembly of claim 6, wherein a pitch of the coupling elements disposed on the top side of the redistribution layer is configured to facilitate coupling the redistribution layer to the one or more transducer elements on the transducer array and a pitch of the coupling elements disposed on the bottom side of the redistribution layer is configured to facilitate coupling the redistribution layer to the plurality of conductive traces on the plurality of interconnect layers in the interconnect structure.

8. The assembly of claim 6, wherein the redistribution layer comprises a plurality of vias configured to facilitate electrical coupling of the one or more coupling elements disposed on the top side of the redistribution layer to the coupling elements disposed on the bottom side of the redistribution layer.

9. The assembly of claim 6, wherein the one or more transducer elements in the transducer array are arranged in a spaced relationship to form a transducer array having a predetermined shape.

10. The assembly of claim 9, wherein the predetermined shape of the transducer array comprises a square, a rectangle, a circle, a rhombus, a triangle, a hexagon, an octagon, or combinations thereof.

11. The assembly of claim 6, wherein the transducer array comprises a piezoelectric array, a micromachined ultrasound array or combinations thereof.

12. The assembly of claim 6, wherein the transducer assembly comprises one of a forward viewing transducer assembly for use in a forward viewing probe, a side viewing transducer assembly for use in a side viewing probe, or an oblique viewing transducer assembly for use in an oblique viewing probe.

13. A transducer assembly, comprising:

a transducer array comprising one or more transducer elements arranged in an 'N×M' grid, wherein N and M are integers;

an interconnect structure disposed proximate the transducer array and comprising 'K' interconnect layers disposed in a spaced relationship, wherein each of the 'K' interconnect layers comprises 'L' conductive traces disposed thereon, wherein 'K' is less than 'M' and 'L' is greater than 'N', and wherein 'K' and 'L' are integers; and a redistribution layer disposed proximate the interconnect structure, wherein the redistribution layer is configured to facilitate coupling the interconnect structure to the one or more elements in the transducer array, the redistribution layer comprising a plurality of coupling elements disposed on a top side and a bottom side thereof, and wherein a pitch of the coupling elements disposed on the top side of the redistribution layer is configured to facilitate coupling the redistribution layer to the one or more transducer elements on the transducer array and a pitch of the coupling elements disposed on the bottom side of the redistribution layer is configured to facilitate coupling the redistribution layer to the plurality of interconnect layers in the interconnect structure.

14. The assembly of claim 13, wherein the redistribution layer comprises a plurality of vias configured to facilitate electrical coupling of the coupling elements disposed on the top side of the redistribution layer to the coupling elements disposed on the bottom side of the redistribution layer.

15. A method for forming a transducer assembly, the method comprising:

providing a transducer array having one or more transducer elements arranged in a spaced relationship;

forming an interconnect structure by disposing a plurality of interconnect layers in a spaced relationship, wherein each of the plurality of interconnect layers comprises a plurality of conductive traces disposed thereon, and wherein a number of the plurality of conductive traces disposed on each of the plurality of interconnect layers is inversely proportional to a number of interconnect layers in the interconnect structure;

disposing a redistribution layer between the interconnect structure and the transducer array to facilitate coupling the transducer array to the interconnect structure, the disposing the redistribution layer comprising patterning a plurality of coupling elements on a top side and a bottom side of the redistribution layer; and coupling the interconnect structure to the transducer array via the redistribution layer.

16. The method of claim 15, wherein patterning the plurality of coupling elements comprises:

arranging the plurality of coupling elements on the top side of the redistribution layer such that a pitch of the coupling elements disposed on the top side is configured to facilitate coupling the redistribution layer to the one or more transducer elements in the transducer array; and arranging the plurality of coupling elements on the bottom side of the redistribution layer such that a pitch of the coupling elements disposed on the bottom side is configured to facilitate coupling the redistribution layer to the plurality of interconnect layers in the interconnect structure.

17. The method of claim 16, further comprising providing a plurality of vias on the redistribution layer to facilitate operatively coupling the coupling elements disposed on the top side of the redistribution layer to the coupling elements disposed on the bottom side of the redistribution layer.

18. The method of claim 15, wherein disposing the redistribution layer comprises disposing the redistribution layer directly on the interconnect structure.

19. A system, comprising:

an acquisition subsystem configured to acquire image data, wherein the acquisition subsystem comprises a probe configured to image a region of interest, wherein the probe comprises at least one transducer assembly, and wherein the at least one transducer assembly comprises:

a transducer array comprising one or more transducer elements arranged in an 'N×M' grid, wherein N and M are integers;

an interconnect structure disposed proximate the transducer array and comprising 'K' interconnect layers disposed in a spaced relationship, wherein each of the 'K' interconnect layers comprises 'L' conductive traces disposed thereon, wherein 'K' is less than 'M' and 'L' is greater than 'N', and wherein 'K' and 'L' are integers;

a redistribution layer disposed proximate the interconnect structure, wherein the redistribution layer is configured to facilitate coupling the interconnect structure to the one or more transducer elements on the transducer array; and a processing subsystem in operative association with the acquisition subsystem and configured to process the image data acquired via the acquisition subsystem.

20. The system of claim 19, further comprising an operator console configured to facilitate a user to manipulate the acquired image data.

21. The system of claim 19, wherein the processing subsystem comprises an imaging system, wherein the imaging system comprises an ultrasound imaging system, a magnetic resonance imaging system, an X-ray imaging system, a nuclear imaging system, a positron emission tomography system, or combinations thereof.

22. The system of claim 21, wherein the imaging system comprises a display module configured to display the processed image data.

* * * * *